United States Patent [19]

Yamanoue et al.

[11] Patent Number: 4,743,901

[45] Date of Patent: May 10, 1988

[54] SIGNAL TRANSMISSION SYSTEM

[75] Inventors: Kouichi Yamanoue, Nishio; Junji Kitagawa, Okazaki, both of Japan

[73] Assignee: Nippon Soken, Inc., Nishio, Japan

[21] Appl. No.: 847,270

[22] Filed: Apr. 2, 1986

[30] Foreign Application Priority Data

Apr. 3, 1985 [JP] Japan ..... 60-70598

[51] Int. Cl.[4] ..... G08C 19/04

[52] U.S. Cl. ..... 340/870.11; 340/870.16; 340/870.38; 340/500; 340/870.19; 340/870.24

[58] Field of Search ..... 340/870.16, 870.39, 340/870.38, 870.37, 825.36, 825.37, 825.77, 825.78, 825.38, 509, 510, 511, 521, 522, 536, 534, 505, 537, 500, 870.11, 870.19, 870.24; 307/356, 357, 273; 370/112, 114; 328/146, 154, 172; 361/282–284; 74/724

[56] References Cited

U.S. PATENT DOCUMENTS

| | | | |
|---|---|---|---|
| 3,797,008 | 3/1974 | Yuasa | 340/511 |
| 3,838,684 | 10/1974 | Manuel et al. | 73/724 |
| 4,118,700 | 10/1978 | Lenihan | 340/537 |
| 4,295,376 | 10/1981 | Bell | 361/283 |
| 4,322,728 | 3/1982 | Ginn | 340/870.11 |
| 4,524,349 | 6/1985 | Hyatt | 340/511 |
| 4,567,471 | 1/1986 | Acar | 340/511 |
| 4,573,041 | 2/1986 | Kitagawa et al. | 340/505 |

*Primary Examiner*—John W. Caldwell, Sr.

*Assistant Examiner*—Alvin Oberley

*Attorney, Agent, or Firm*—Cushman, Darby & Cushman

[57] ABSTRACT

A signal transmission system has a plurality of sensors, a plurality of modulation circuits connected to the sensors, a single demodulation circuit and a single power supply line for connecting the modulation circuits to the demodulation circuit. Each of the sensors has a resistor-capacitor type oscillation circuit of which the capacity varies with the variation of a physical quantity to be measured and outputs an oscillation output of the oscillation circuit as a sensor signal. Each of the modulation circuit has a one-shot circuit having a predetermined set time different from another one-shot circuit of another modulation circuit for sustaining the sensor signal for the predetermined set time. Each of the modulation circuits further has a transistor for switching and a zener diode of a zener voltage different from that of another zener diode of another modulation circuit. The transistor connects the zener diode to the electric power line to lower the voltage of the electric power line to the zener voltage when the sensor signal is inputted. The demodulation circuit has a plurality of comparators and a logic circuit. Each of the comparators compares the voltage of the power supply line with a reference voltage to generate a comparison signal. The logic circuit performs a logical operation of the comparison signals from the comparators to obtain the sensor signals at different output terminals.

14 Claims, 9 Drawing Sheets

SIGNAL TRANSMISSION SYSTEM

BACKGROUND OF THE INVENTION

1. Field of the Invention

The present invention relates to a signal transmission system and more particularly to a signal transmission system suitable for the concentrical monitor of signals from various sensors for engine oil, a cooling water and the like.

2. Description of the Prior Art

Vehicles are provided with various sensors at various positions thereof. The kind and the number of the sensors tend to increase with the recent development of car electronics.

Signals from the various sensors are concentrically monitored by an instrument panel within a vehicle room.

Conventionally, for the above purpose, various sensors are connected to the instrument panel separately. This results in the number of wiring being increased with the increment of the sensors, and accordingly the number of wiring processes and the size of the wire harness being increased.

SUMMARY OF THE INVENTION

One object of the present invention is to provide a signal transmission system enabling the transmission of a large number of sensor signals by simple wiring.

Another object of the present invention is to provide a signal transmission system enabling the multi-transmission of sensor signals by using a single signal line.

The signal transmission system of the present invention comprises a plurality of sensors, each sensing the variation of a physical quantity and outputting a sensor signal, a single signal line, a plurality of modulation circuits of the same number as the sensors, for varying the voltage of the single signal line by predetermined different values when the sensor signal from each of the sensors are inputted to the modulation circuits and a single demodulation circuit for detecting the voltage variation of the single signal line thereby to obtain the sensor signal. Each of the sensors is connected to each of input portions of the modulation circuits and one end of the single signal line is connected to each of output portions of the modulation circuits while the other end of the single signal line is connected to the demodulation circuit.

According to the signal transmission system of the present invention, a plurality of sensor signals can be transmitted through a single power supply line. Therefore, when the number of the sensors is increased, the number of wires is not increased. This results in the number of wiring processes being reduced and the size of the wiring harness being decreased.

BRIEF DESCRIPTION OF THE DRAWINGS

FIGS. 1 to 4 illustrate a first embodiment of a signal transmission system according to the present invention;

FIG. 1 is a wiring diagram of the whole system;

FIGS. 2A, 2B, 2C and 2D are signal time charts;

FIG. 3 is a circuit diagram of a demodulation circuit;

FIG. 5 is a circuit diagram of a demodulation circuit;

FIG. 6 is a view illustrating the conversion characteristic of an A/D converter;

FIGS. 7 to 9 illustrate a third embodiment of the signal transmission system according to the present invention;

FIG. 7 is a wiring diagram of the whole system;

FIG. 8 is a circuit diagram of a demodulation circuit;

DETAILED DESCRIPTION OF THE EMBODIMENTS

Embodiment 1

Figure 1:
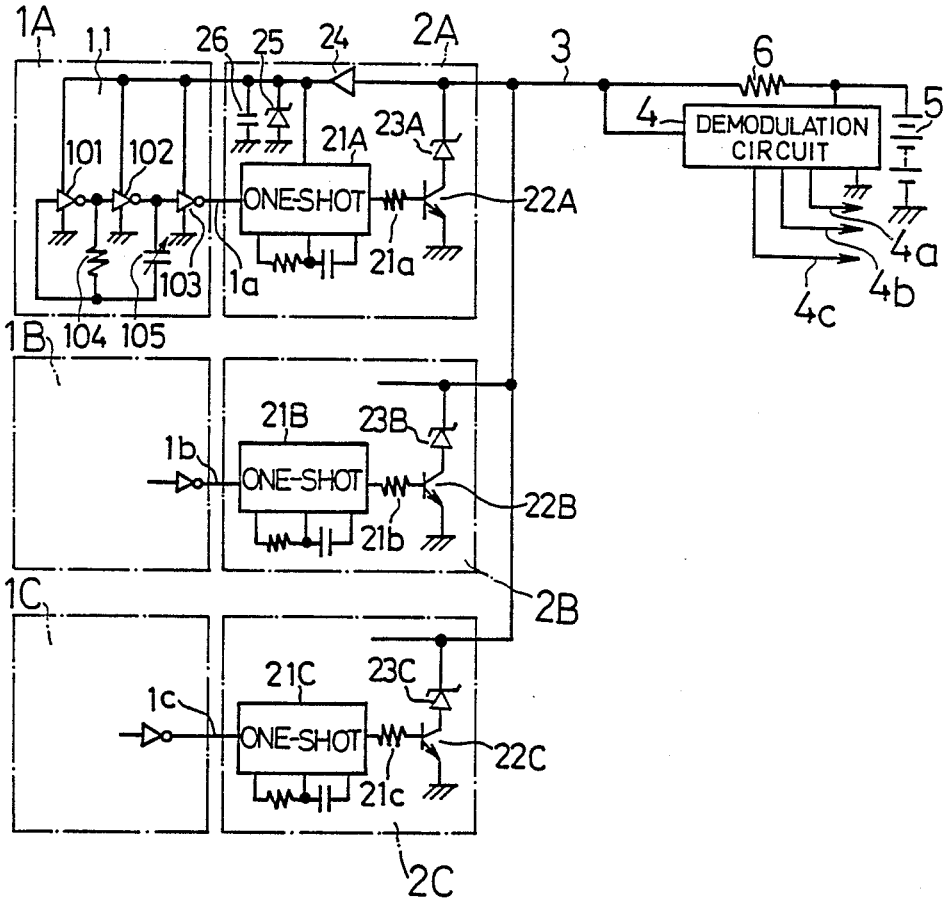

As shown in FIG. 1, each of sensors 1A, 1B and 1C installed at various positions of a vehicle, is connected to each of modulation circuits 2A, 2B, and 2C. Each of sensor signals **1*a*, 1*b*, 1*c* is inputted to each of the modulation circuits 2A to 2C. The modulation circuits 2A to 2C are connected to a demodulation circuit 4 installed near an instrument panel by means of a power supply line 3. The power supply line 3 is connected to a battery 5 installed in the vehicle through a resistor 6**.

The sensors 1A to 1C have the same structure as one another.

Each of the sensors 1A to 1C has a resistor-capacitor oscillation circuit 11 composed of invertors 101, 102 and 103, a resistor 104 and a variable capacitor 105.

The electrostatic capacity of the variable capacitor 105 varies with the variation of the physical quantity such as the surface level of oil and cooling water to be detected.

This results in the frequency of the oscillation output of the oscillation circuit 11 being varied. And the sensors 1A to 1C output the oscillation outputs as the sensor signals **1*a* to 1*c***.

The modulation circuits 2A, 2B and 2C have the same structure as one another and each modulation circuit 2A, 2B or 2C has a one-shot 21A, 21B, or 21C, each being set to different pulse widths, a transistor 22A, 22B or 22C for switching, a zener diode 23A, 23B or 23C having different zener voltage VA, VB or VC, and a smoothing circuit composed of a diode 24, a zener diode 25 and a capacitor 26.

The above described zener voltages VA to VC have a relation of $VA > VB > VC$.

Figure 2:
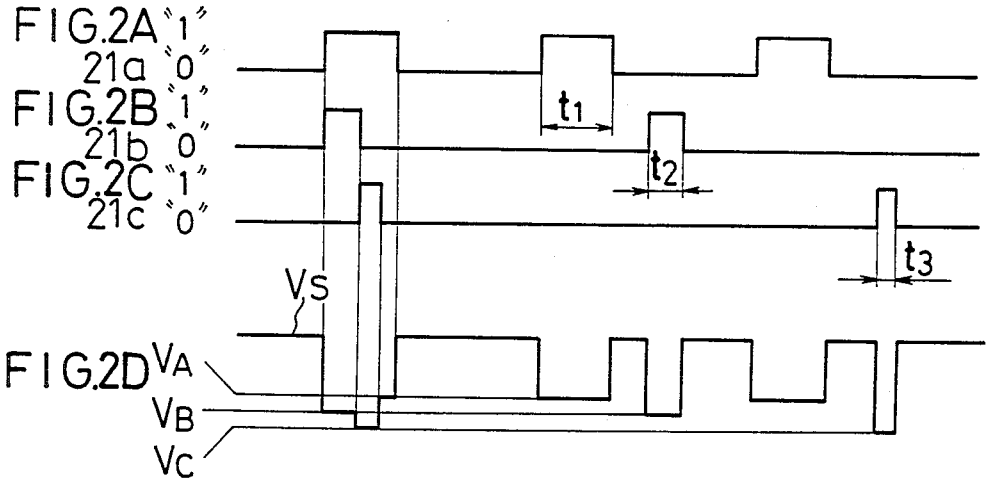

The one-shots 21A to 21C output pulse signals **21*a*, 21*b*, and 21*c* having predetermined pulse widths of $t_1$, $t_2$ and $t_3$, respectively as shown in FIGS. 2A, 2B and 2C every time when the sensor signal 1*a* to 1*c*** are inputted. The pulse widths $t_1$ $t_2$ and $t_3$ have a relation of $t_1 = 2t_2 = 4t_3$.

Each of the transistors 22A to 22C conducts every time when each of the pulse signals **21*a* to 21*c* is inputted. Thus, the zener diodes 23A to 23C are connected to the power supply line 3**.

This results in the voltage of the power supply line (VS) being dropped to the lowest zener voltage out of the voltages VA to VC of the zener diodes 23A to 23C as shown in FIG. 2D.

Figure 3:
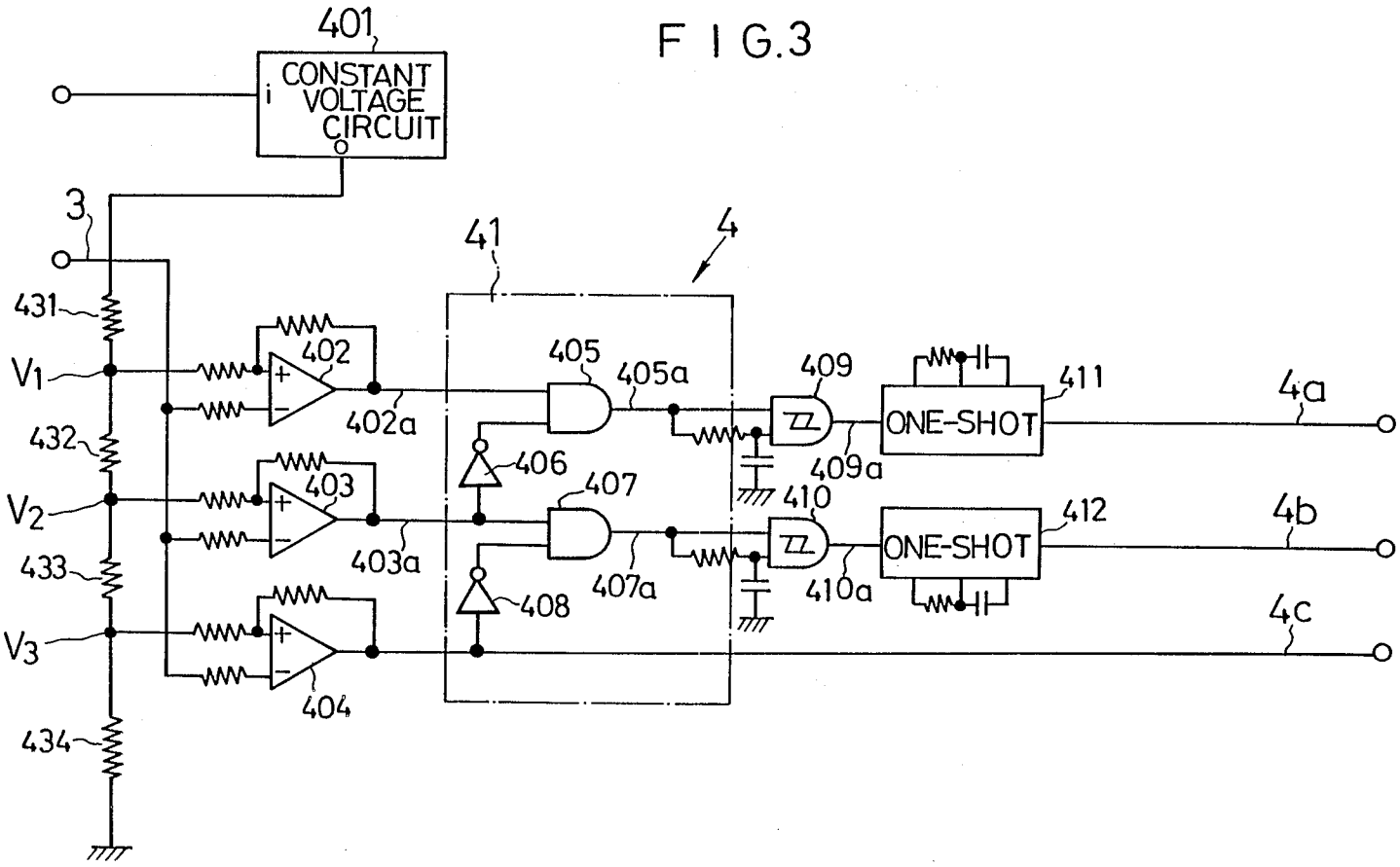

The detailed structure of the demodulation circuit 4 is shown in FIG. 3.

The reference numeral 401 designates a constant-voltage circuit. An input terminal i is connected to the battery 5 (FIG. 1) while an output terminal 0 is connected to a plurality of resistors 431, 432, 433 and 434 in series to generate refernece voltages $V_1$, $V_2$ and $V_3$.

The reference voltages $V_1$, $V_2$ and $V_3$ are inputted to noninverting input terminals of comparators 402, 403, and 404.

To inverting input terminals of the comparators 402 to 404 is connected the power supply line 3. The reference voltages $V_1$ to $V_3$ are set so as to satisfy the relation of $V_1 > VA > V_2 > VB > V_3 > VC$.

Figures 4A, 4B, 4C, 4D, 4E, 4F, 4G, 4H, 4I, 4J:
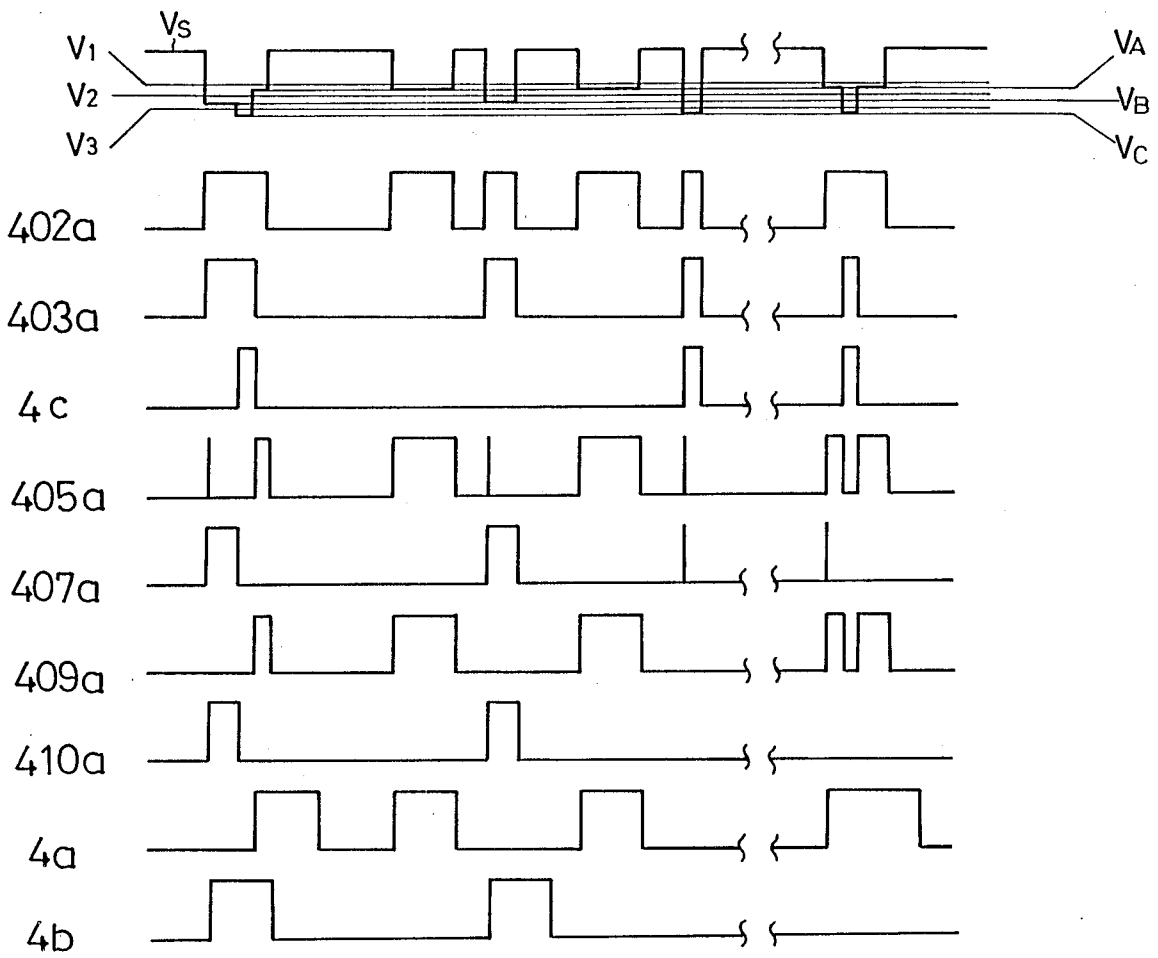
FIGS. 4A, 4B, 4C, 4D, 4E, 4F, 4G, 4H, 4I and 4J are signal time charts.

When the voltage of the power supply line (VS) which is dropped in accordance with the sensor signals 1*a* to 1*c* as shown in FIG. 4A is inputted to each of the comparators 402 to 404, comparison signals 402*a*, 403*a*, and 4*c* (FIGS. 4B, 4C and 4D) are outputted therefrom.

The signal 4*c* corresponds to only the pulse signal 21*c* (FIG. 2C). Therefore, the signal 4*c* rises up simultaneously with the rising of the sensor signal 1*c* and has the same frequency as that of the sensor signal 1*c*.

In contrast, in the signal 402*a* are mixed the pulse signals 21*a*, 21*b* and 21*c* and in the signal 403*a* are mixed the pulse signals 21*b* and 21*c*.

These signals 402*a* and 403*a* are inputted to a logic circuit 41 composed of AND gates 405 and 407 and inverters 406 and 408.

By the logic circuit 41, unnecessary pulse signals 21*b* and 21*c* are removed from the signal 402*a* and unnecessary pulse signal 21*c* is removed from the signal 403*a*. As a result, signals 405*a* and 407*a* as shown in FIGS. 4E and 4F are obtained.

The signals 405*a* and 407*a* are inputted to AND gates 409 and 410, each being provided with a low-pass filter composed of a resistor and a capacitor on the input side thereof. By the AND gates 409 and 410, noise pulses generated due to the operation log of the AND gates 405, and 407 and the inverters 406 and 408 are removed. As a result, the signals 409*a* and 410*a* as shown in FIGS. 4G and 4H are obtained.

The signals 409*a* and 410*a* are inputted to the one-shots 411 and 412 to obtain signals 4*a* and 4*b* having predetermined pulse widths.

These signals 4*a* and 4*b* correspond to the pulse signals 21*a* and 21*b*, respectivey, and accordingly rise up simultaneously with the rising of the sensor signals 1*a* and 1*b* respectively while each having the same frequency as that of each of the sensor signals 1*a* to 1*b*.

By virtue of the provision of the one-shots 411 and 412, even when the signal 409*a* is cut by the signal 403*a*, for example, as shown on the right of FIG. 4G, the obtained signal 4*a* is not affected thereby.

In this case, the pulse widths of the one-shots 411 and 412 are set larger than that of the pulse signal 21*a*.

By counting the signals 4*a*, 4*b* and 4*c* outputted from the demodulation circuit 4 every unit time to measure the frequency thereof, the variation of the physical quantity detected in the sensors 1A, 1B and 1C can be measured.

As described above, according to the signal transmission system of the present embodiment, a plurality of sensor signals can be transmitted by a single power supply line connecting the modulation circuit to which the sensors are connected, to the demodulation circuit. Therefore, particularly when a large number of sensors are installed, the number of wiring processes can be remarkably reduced. And when the signal transmission system of the present embodiment is installed in a vehicle, the size of the wiring harness can be largely decreased.

Embodiment 2

Figure 5:
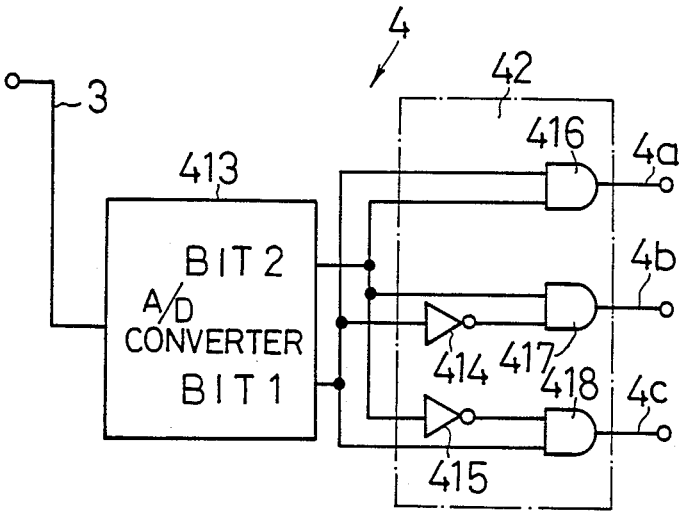
FIGS. 5 and 6 illustrate a second embodiment of the signal transmission system according to the present invention.

FIG. 5 illustrates another example of the demodulation circuit. In FIG. 5, the reference numeral 413 designates an A/D converter. The inverters 414 and 415 and AND gates 416, 417 and 418 compose a decoder circuit 42.

Figure 6:
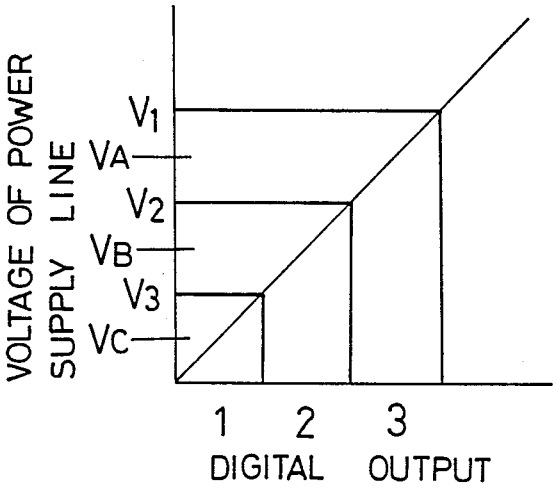

To an input terminal of the A/D converter 413 are connected the power supply line 3. The A/D converter generates a digital output from output terminals BIT 1, BIT 2 in accordance with the voltage of the power supply line 3. The voltage of the power supply line (VS) is related to the digital output as shown in FIG. 6. For example, when the voltage of the power supply line is VB, the outputs of the terminals BIT 1 and BIT 2 are "1" level and "0" level, respectively.

By decoding this digital output, signals 4*a*, 4*b* and 4*c* which are same as those of the first embodiment can be obtained.

Embodiment 3

Figure 7:
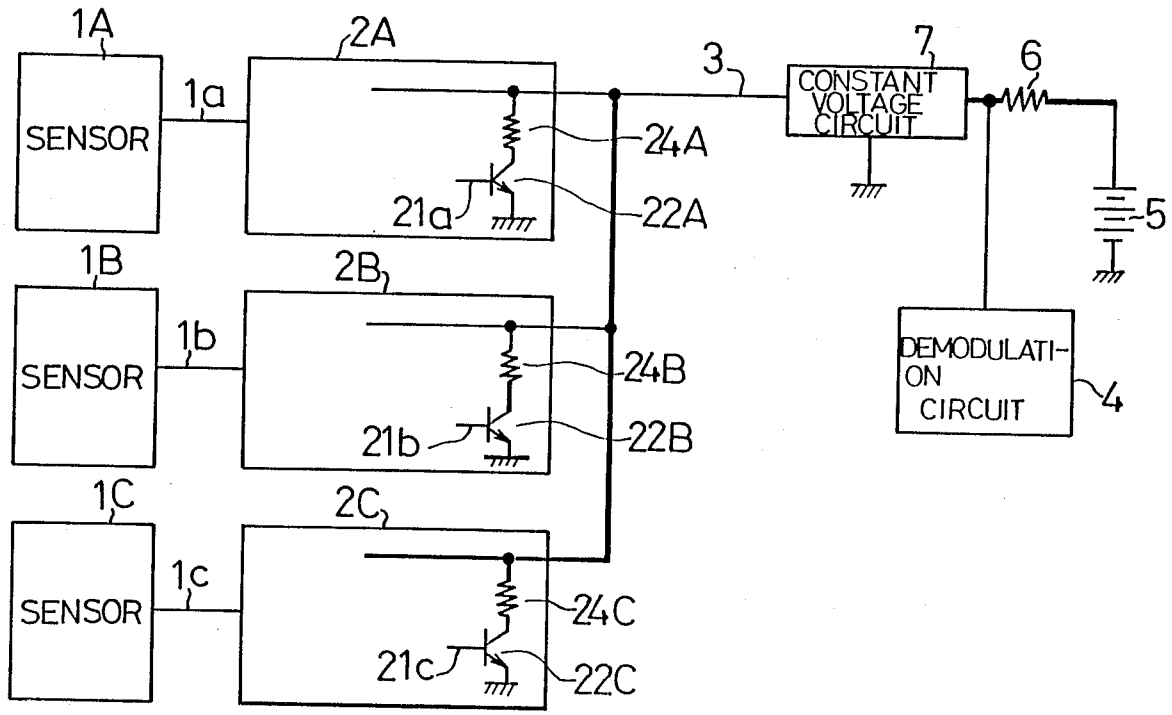

The zener diodes 23A, 23B and 23C of the modulation circuits 2A, 2B and 2C shown in FIG. 1 can be replaced by the resistors 24A, 24B and 24C as shown in FIG. 7. In FIG. 7, the reference numeral 7 designates a constant-voltage circuit. The structure of the sensors 1A, 1B and 1C and the modulation circuits 2A to 2C except for the resistors 24A, 24B and 24C is substantially equal to that shown in FIG. 1.

Figures 9A, 9B, 9C, 9D, 9E, 9F, 9G:
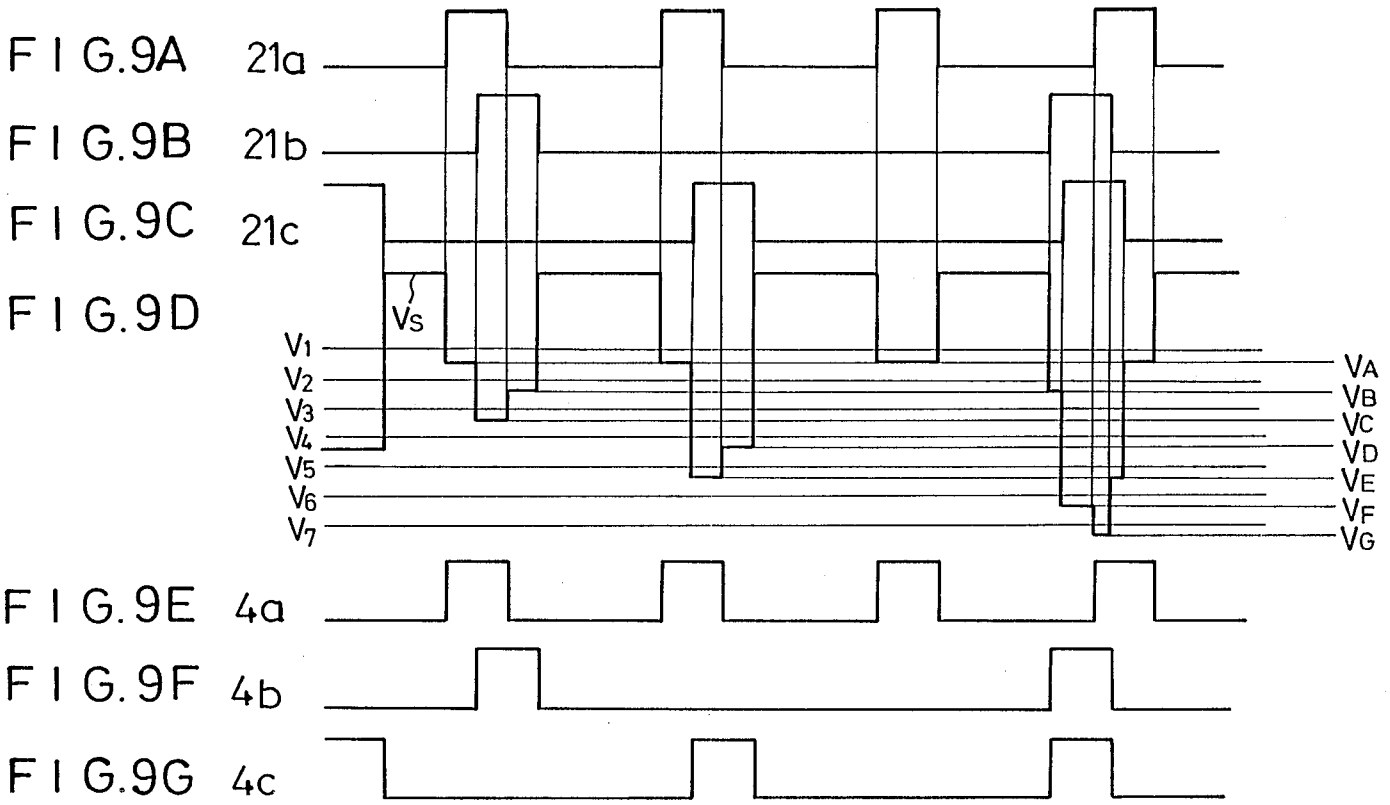
FIGS. 9A, 9B, 9C 9D, 9E, 9F and 9G are signal time charts.
Figure 10:
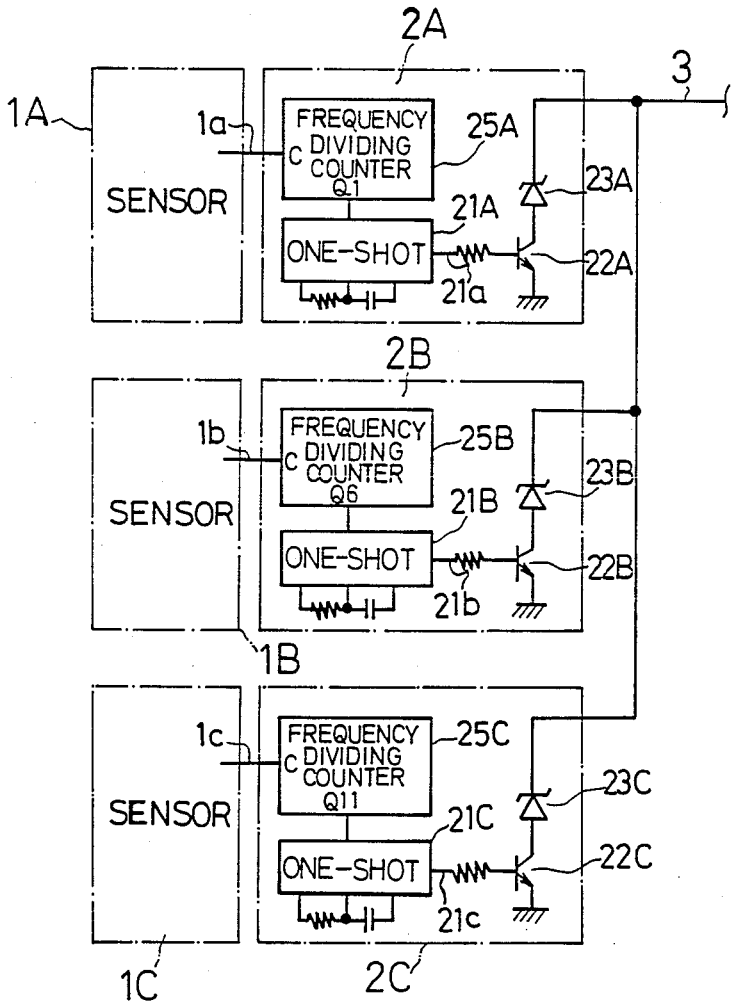
FIG. 10 is a circuit diagram of a modulation circuit used in a fourth embodiment of the signal transmission sensor according to the present invention.

When the sensor signals 1*a* to 1*c* are outputted from the sensors 1A to 1C and the pulse signals 21*a*, 21*b* and 21*c* (FIGS. 9A, 9B and 9C) are inputted to the transistors 22A, 22B and 22C of the modulation circuits 2A to 2C, the resistors 24A to 24C are connected to the power supply line 3 to vary the electric current in the resistor 6. This results in the voltage of the power supply line VS inputted to the demodulation circuit 4 varying as shown in FIG. 9D.

The resistance values $R_1$ to $R_3$ of the resistors 24A to 24C are determined by the equations (i) and (ii).

$$\left(R_1 - \frac{R_1 R_2}{R_1 + R_2}\right)\frac{1}{R_1 - R_2} = 2 \quad \text{(i)}$$

$$(R_2 - R_3)\frac{1}{R_2 - \frac{R_1 R_2}{R_1 + R_2}} = 2 \quad \text{(ii)}$$

By selecting the combination of the resistors 24A to 24C and the power supply line 3, the voltage of the power supply line (VS) can take seven voltage values of VA, VB, VC, VD, VE, VF and VG as shown in FIG. 9D. These voltage values are gradually increased from VG to VA and each of these voltage values is two times as large as the smaller voltage value.

Figure 8:
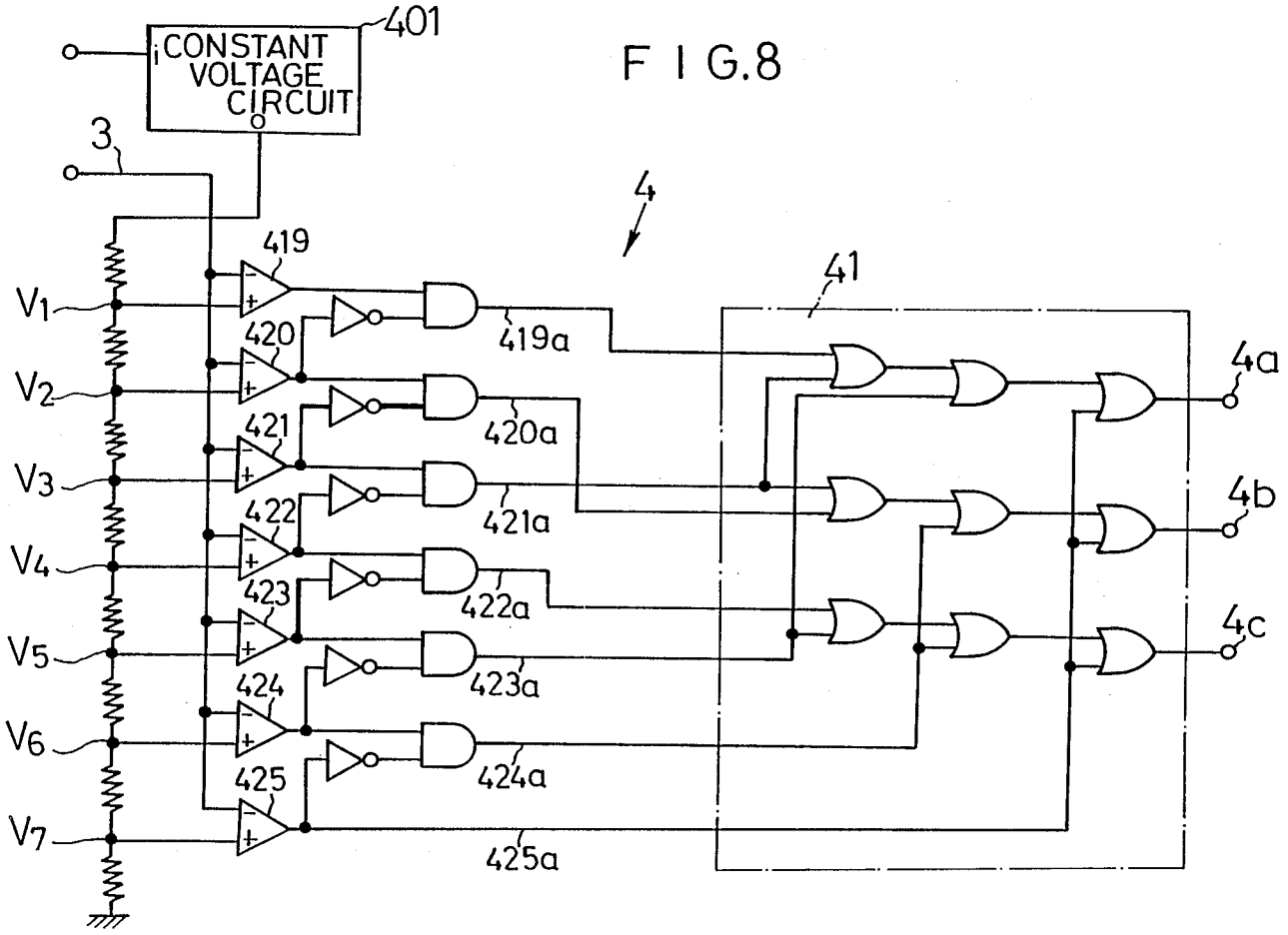

The structure of the demodulation circuit 4 is shown in FIG. 8.

In FIG. 8, the reference numerals 419, 420, 421, 422, 423, 424 and 425 designate comparators. Resistors connected to the constant-voltage circuit 401 in series generate reference voltages $V_1$, $V_2$, $V_3$, $V_4$, $V_5$, $V_6$ and $V_7$. Each of the voltages of the power supply line (VA to VG) is smaller than the corresponding reference voltage out of $V_1$ to $V_7$ as shown in FIG. 9D.

When the voltage value of the voltage of the power supply line (VS) varies, one of the signals 419*a* to 425*a* in FIG. 8 becomes "1" level.

By inputting these signals of "1" level into the logic circuit 41 composed of gate groups, signals 4*a*, 4*b*, 4*c* (FIGS. 9E, 9F and 9G) can be obtained.

According to the third embodiment, by arbitrarily selecting the resistance values of the resistors 24A to 24C, the dropping amount of the voltage of the power supply line (VS) can be freely determined.

And according to the third embodiment, the voltage (VS) is varied into different voltage values of VA to VG in accordance with the combination of the sensor signal outputs, and accordingly the widths of the pulse signals 21*a* to 21*c* are not required to be made different from one another.

The comparators 419 to 425 and the logic circuit 41 can be replaced by an A/D converter and a decoder as shown in the second embodiment.

Embodiment 4

In the first embodiment, the pulse widths of the one-shots 21A to 21C of the modulation circuits 2A to 2C are made different from one another for discriminating the pulse signals 21*a* to 21*c* outputting at the same time.

Instead, in the fourth embodiment, frequency dividing counters 25A, 25B and 25C are provided in the modulation circuits 2A, 2B and 2C for dividing the frequency of the sensor signals 1*a*, 1*b* and 1*c* to be inputted to the one-shots 21A to 21C. In this case, the frequency dividing ratios of the counters 25A to 25C are made largely different from one another so that several pulses of the pulse signal 21*a* always appear in every period of the pulse signal 21*b* and that several pulses of the pulse signal 21*b* always appear in every period of the pulse signal 21*c*.

The remaining portion of each of the modulation circuits 2A to 2C, the sensors 1A to 1C and the demodulation circuit 4 of the fourth embodiment have the structure substantially equal to those of the first embodiment.

According to the fourth embodiment, the output timings of the pulse signals 21*a* to 21*c* are not frequently overlapped with one another. If they are overlapped with one another, the frequency of the signals 4*a* to 4*c* from the demodulation circuit 4 can be obtained by measuring the period of the signals 4*a* and 4*b* appearing in one period of the signal 4*b* or 4*c*.

In this case, the pulse width of each of the one-shots 21A to 21C of the modulation circuits 2A to 2C can be made equal to one another.

What is claimed is:

1. A signal transmission system comprising:

a plurality of sensors, each sensing the variation of a physical quantity and outputting a sensor signal;

a single signal line;

a plurality of modulation circuits of the same number as said sensors, each of said plurality of modulation circuit outputting a pulse output of a predetermined pulse width different from those of another pulse output from another one of said plurality of modulation circuits for varying the voltage drop to said single signal line by predetermined different values in response to said sensor signal outputted by each of said plurality of sensors; said plurality of sensors being connected to input portions of respective modulation circuits; and one end of said single signal line being connected to each of output portions of said plurality of modulation circuits thereby to transmit a plurality of pulse outputs from said plurality of modulation circuits; and a single demodulation circuit for detecting the different pulse widths and voltage drops caused by said plurality of pulse outputs of said single signal line thereby to obtain said sensor signal of each of said plurality of sensors, the other end of said single signal line being connected to said single demodulation circuit.

2. A signal transmission system according to claim 1, wherein said single signal line is a single power supply line for said modulation circuit and said demodulation circuit.

3. A signal transmission system according to claim 1, wherein each of said plurality of sensors is provided with a resistor-capacitor type oscillation circuit of which the capacity varies with the variation of the physical quantity to be sensed and outputs an oscillation output of said resistor-capacitor type oscillation circuit as said sensor signal.

4. A signal transmission system according to claim 1, wherein each of said modulation circuits is provided with a switching element operating when said sensor signal is inputted to each of said modulation circuits, and zener diodes having different zener voltages, which are connected to said signal line when said switching element is operated.

5. A signal transmission system according to claim 1, wherein each of said modulation circuits is provided with a switching element operating when said sensor signal is inputted to each of said modulation circuits, and resistors having different resistance values, which are connected to said signal line when said switching element is operated.

6. A signal transmission system according to claim 1, wherein each of said modulation circuits is provided with a one-shot circuit for sustaining said sensor signal inputted to each of said modulation circuits for a predetermined time.

7. A signal transmission system according to claim 3, wherein each of said modulation circuits is provided with a frequency dividing circuit for dividing the frequency of said sensor signal inputted to each of said modulation circuits and varying the frequency of said sensor signal.

8. A signal transmission system according to claim 1, wherein said demodulation circuit is provided with a plurality of comparators for comparing the voltage of said single signal line with different reference voltages and generating a plurality of comparison signals, and a logic circuit for performing a logical operation of said pluraity of comparison signals thereby to obtain said sensor signals at output terminals of said demodulation circuit.

9. A signal transmission system according to claim 1, wherein said demodulation circuit is provided with an A/D converter for generating a digital output in accordance with the voltage value of said signal line and a decoder circuit which obtains said sensor signals in different output terminals of said decoder circuit in accordance with the digital output outputted by said A/D converter.

10. A signal transmission system according to claim 1, wherein each of said plurality of modulation circuits outputs said pulse signal of frequency corresponding to the variation of the physical quantity.

11. A signal transmission system according to claim 1, wherein said plurality of sensors are composed of a first sensor for sensing the variation of a first physical quantity and outputting a first sensor signal and a second sensor for sensing the variation of a second physical quantity and outputting a second sensor signal, said plurality of modulation circuits are composed of a first modulation circuit for outputting a first pulse output of variable frequency corresponding to said first sensor signal of said first sensor, a first constant pulse width and a first constant voltage drop, to said single signal line, and a second modulation circuit for outputting a second pulse output of a variable frequency corresponding to said second sensor signal of said second sensor, a second constant pulse width smaller than that of said first constant pulse width, and a second constant voltage drop different from that of said first constant voltage drop, to said single signal line, and said single demodulation circuit detects said pulse outputs of said single signal line thereby to obtain said first sensor signal and said second sensor signal.

12. A signal transmission system according to claim 11, wherein said plurality of sensors are further composed of a third sensor for sensing the variation of a third physical quantity and outputting a third sensor signal, and said plurality of modulation circuits are further composed of a third modulation circuit for outputting a third pulse output of variable frequency corresponding to said third sensor signal of said third sensor, a third constant pulse width smaller than that of said second constant pulse output, and a third constant voltage drop different from that of said first and second constant voltage drop, to said single signal line, and said first constant pulse width, said second constant pulse width and said third constant pulse width have a predetermined relation to each other.

13. A signal transmission system according to claim 12, wherein said relation is expressed by the following equation:

$$t_1=2t_2=4t_3$$

where $t_1$ is said first constant pulse width, $t_2$ is said second constant pulse width and $t_3$ is said third constant pulse width.

14. A signal transmission system according to claim 12, wherein said first constant voltage drop, said second constant voltage drop, and said third constant voltage drop has the following relation to each other;

$$VA>VB>VC$$

where VA is said first constant voltage drop, VB is said second constant voltage drop and VC is said third constant voltage drop.

* * * * *